United States Patent [19]

Heinisch

[11] Patent Number: 4,979,086

[45] Date of Patent: Dec. 18, 1990

[54] LUMINAIRE HAVING MAIN AND SECONDARY REFLECTOR SECTIONS

[75] Inventor: Richard V. Heinisch, Scottsdale, Ariz.

[73] Assignee: Lowering Systems, Inc., Chicago, Ill.

[21] Appl. No.: 507,857

[22] Filed: Apr. 12, 1990

[51] Int. Cl.[5] ..... F21V 7/00

[52] U.S. Cl. ..... 362/297; 362/346; 362/347

[58] Field of Search ..... 362/297, 296, 346–350, 362/341

[56] References Cited

U.S. PATENT DOCUMENTS

| | | | |
|---|---|---|---|
| 1,950,380 | 3/1934 | Arras | 362/297 |
| 3,213,271 | 10/1965 | Tolbert | 362/297 |
| 4,242,727 | 12/1980 | deVos et al. | 362/297 |
| 4,575,788 | 3/1986 | Lewin | 362/297 |

*Primary Examiner*—James C. Yeung
*Attorney, Agent, or Firm*—LaValle D. Ptak

[57] ABSTRACT

A luminaire is disclosed for producing uniform rectangular or square patterns of light. The luminaire itself consists of eight, curved main reflector sections which are concentrically located about a bulb mounting location opposite the open side of the housing in which the luminaire is mounted. The main reflector sections are joined together at their edges, such that cross sections of the luminaire in planes parallel to the open side of the housing form octagons of decreasing size as the cross sections are taken at increasingly greater distances from the open side of the housing. The orientation of the main reflector sections is such that alternate points of the octagon are located in alignment with the center of the bulb placed in the center of the reflector sections and corners of the area to be illuminated. In these corners, flat secondary reflector sections, which extend part way into the luminaire, are attached to the main reflector sections to increase the concentration of light reflected from the light source in the center of the luminaire to the corners of the area to be illuminated.

15 Claims, 2 Drawing Sheets

FIG. 1
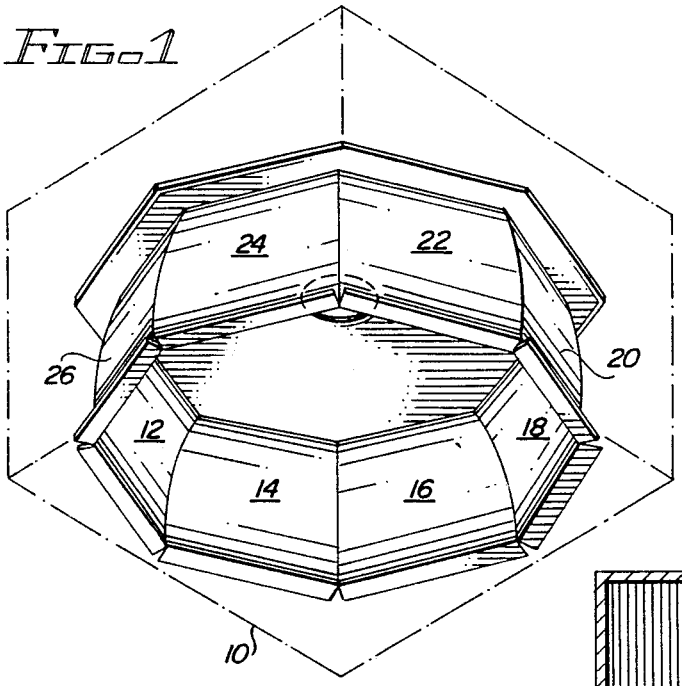
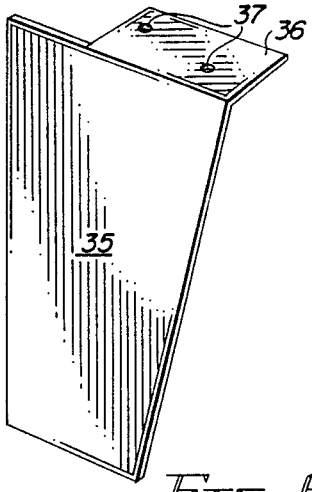
FIG. 6
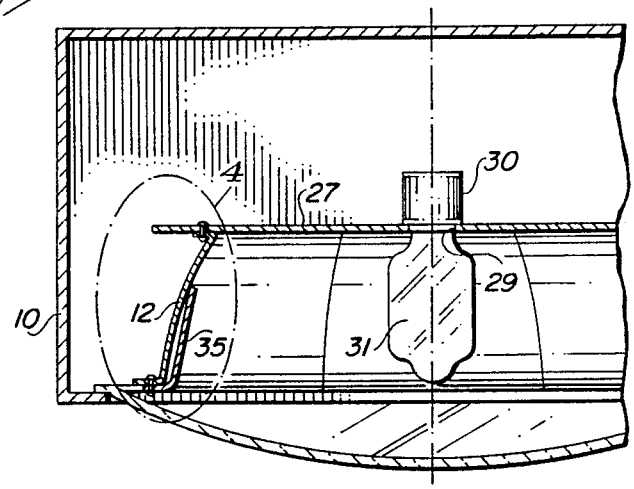
FIG. 3
FIG. 1A
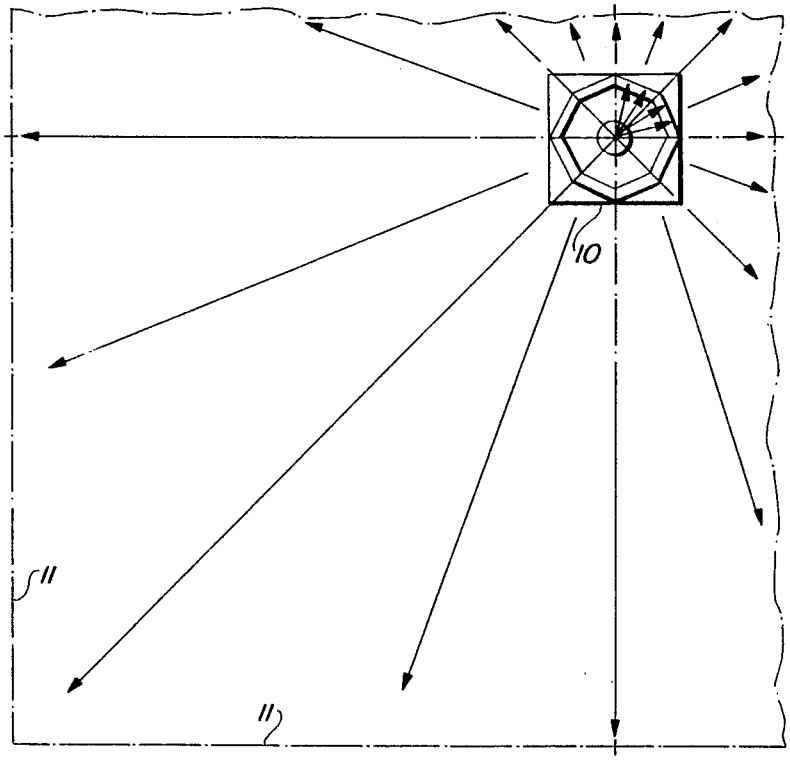
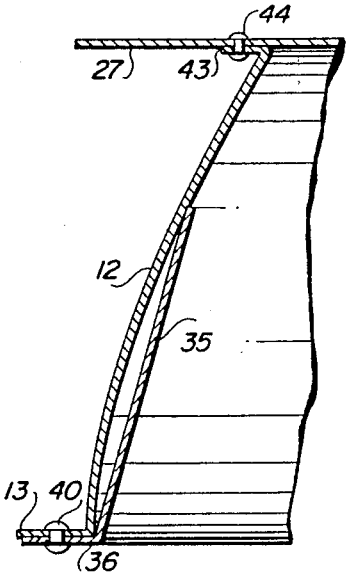
FIG. 4

FIG. 2
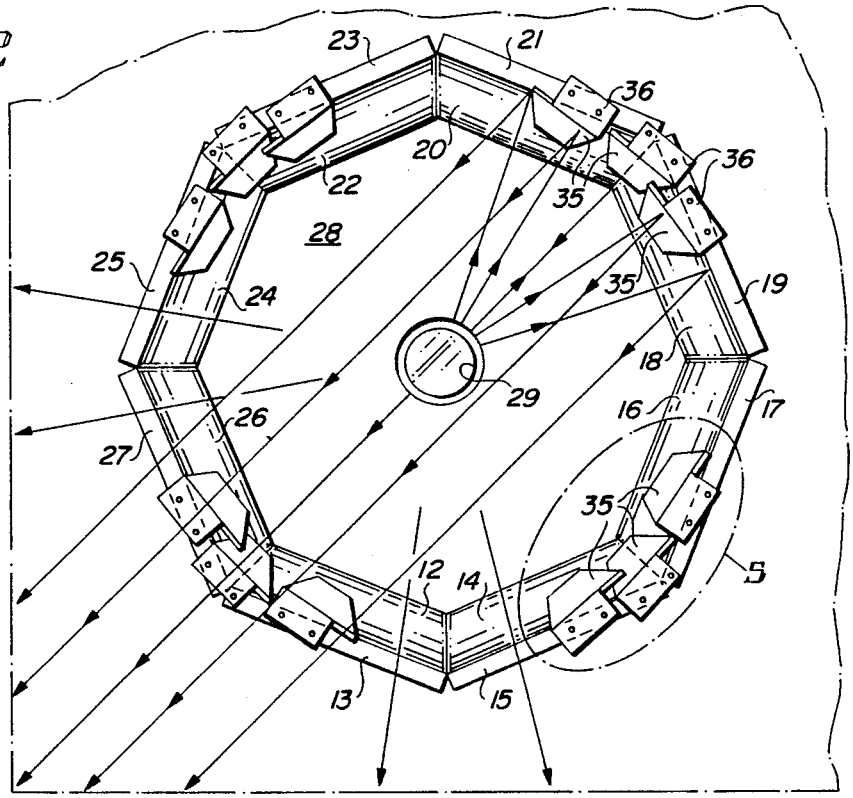
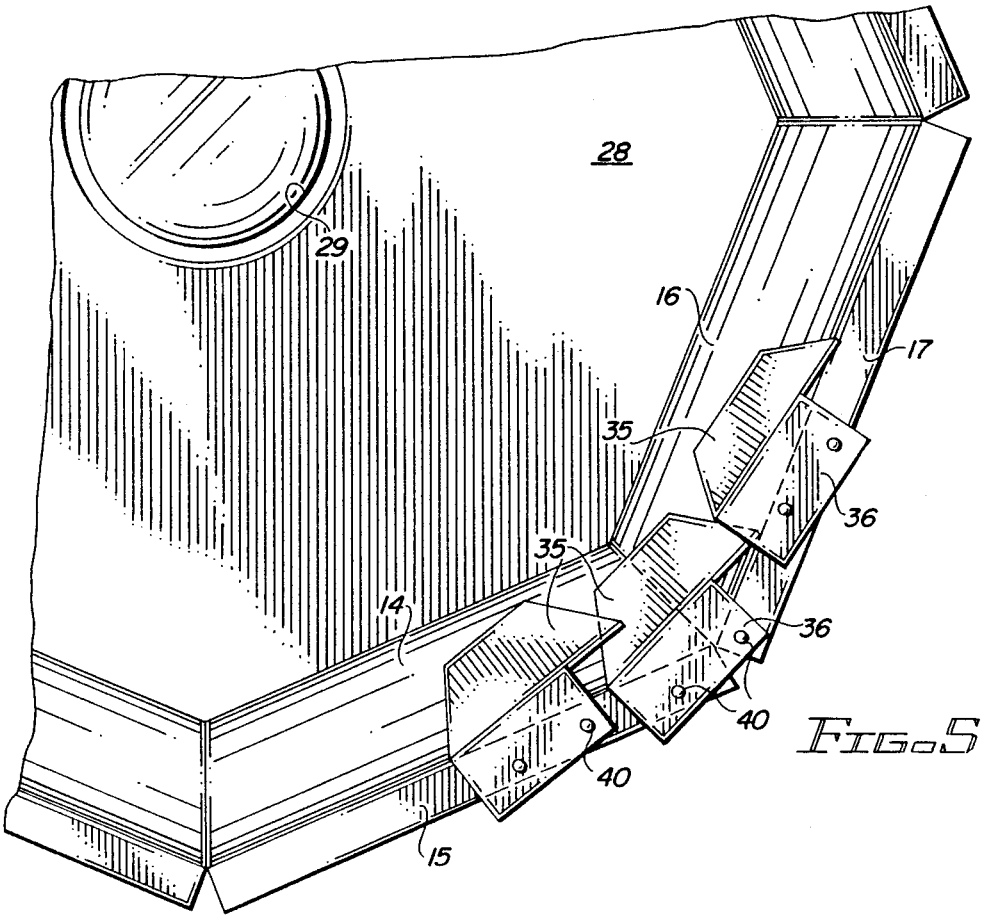
FIG. 5

LUMINAIRE HAVING MAIN AND SECONDARY REFLECTOR SECTIONS

BACKGROUND

In the design of lighting systems of the type used for illuminating roadways, parking lots, warehouses and the like, a primary goal is to obtain uniform illumination of the area covered by each individual light fixture or luminaire in the system to avoid bright spots and dark spots on the surface being illuminated. It is especially desirable to provide a fixture capable of producing a relatively uniform light intensity over rectangular or square areas, such that the corners of the square receive substantially the same amount of illumination as the sides of the square.

It also is desirable to minimize, as much as possible, the total amount of energy which is consumed by any lighting system, since energy costs in recent years have increased substantially. Because of the low energy consumption which they require, high intensity discharge (HID) lamps have found widespread acceptance in commercial applications. HID lamps produce strong light patterns in planes perpendicular to the lamp axis so that, typically, such lamps are mounted in planes perpendicular to the plane of the surface to be illuminated. As a result, the reflector segments of the luminaire are uniformly spaced around the lamp axis.

When a pattern of luminaires is designed to illuminate a given area, such as a parking lot, the lighting engineer has a limited number of choices of light distributions which are effected by employing pole layouts in various patterns. For example, if the pole layout is in the form of squares, it is desirable to employ luminaires, each one of which produces a square pattern of light. Consequently, the square patterns of light then may be nested against each other to provide complete coverage of the area to be lighted In other situations, where the layout of the light poles may be on a rectangular pattern, a rectangular pattern of light from the individual luminaires is beneficial. Whenever a luminaire produces a pattern of light which does not fit the exact area to be lighted, a problem is created with spilled light, lighting unwanted areas with consequent power wastage, or portions of the area to be lighted may have inadequate illumination.

In the past, attempts have been made to adjust the patterns of light emanating from a luminaire by the provision of segmented adjustable reflector sections in the luminaire. A typical luminaire of this type, used with an incandescent lamp, is disclosed in the patent to Tolbert, U.S. Pat. No. 3,213,271. This patent is directed to a luminaire used for lighting residential streets and includes a pair of compound curved reflector segments, mounted on opposite sides of the bulb. These reflector segments each are individually adjustable by sliding them in grooves to effect both vertical orientation or tilting, and horizontal positioning about the bulb. As a result, reflected light is shifted within a limited range upwardly or downwardly, to direct the beam of light in the appropriate directions on a hilly road, and also to adjust the beam laterally to maximize the direction of the beam on a curve in the road, when the light fixture is located at such a curve. This fixture is not intended for providing uniform illumination of a square or rectangular area, however.

Another luminaire, with adjustable reflectors in it for the purpose of providing an assymetrical illumination of the region beneath the fixture is disclosed in the patent to Mousset, U.S. Pat. No. 4,261,029. The fixture of the Mousset patent mounts a lamp in an eccentric position within the fixture and locates adjustable reflector elements on opposite sides of the light-producing planes of the lamp to direct the light from the fixture off to one side of the region located beneath the fixture. There is no attempt, in the device disclosed in this patent, to compensate for reduced illumination in the corners of square or rectangular areas to be illuminated.

A luminaire utilizing an HID bulb mounted in a plane with its axis parallel to the plane of the open side of the luminaire housing is disclosed in the patent to Lewin, U.S. Pat. No. 4,575 788. The luminaire of the Lewin patent includes a housing which has four identical primary compound-curved reflector sections oriented with two sections on each side of the lamp, to produce major projections of the light emanating from the luminaire diagonally of the longitudinal axis of the lamp in a horizontal plane. This creates a generally square or rectangular distribution of light on the surface to be illuminated. Since HID lamps inherently have reduced lamp intensity along the direction of the axis of the lamp, auxiliary reflector sections are placed at the ends of the bulb and interconnect the four main reflector sections, to create an increase in the light projected along the lamp axis. This increase compensates for the reduction in inherent lamp intensity along its axis. The specific arrangement of reflector sections disclosed in the Lewin patent, however, is unique to the somewhat non-standard "horizontal" mounting of the lamp in the fixture. The Lewin luminaire does not have application to an HID lamp which is mounted with its axis perpendicular to the open side of the luminaire housing.

It is desirable to provide a luminaire utilizing either an HID light source or an incandescent light source, which is capable of producing relatively uniform illumination of a square or rectangular area, which utilizes a relatively small number of parts, and which is simple to construct.

SUMMARY OF THE INVENTION

Accordingly, it is an object of this invention to provide an improved luminaire.

It is another object of this invention to provide an improved luminaire which produces uniform rectangular or square light patterns.

It is an additional object of this invention to provide a luminaire with auxiliary secondary reflector sections to augment light reflected into the corners of rectangular areas to be illuminated.

It is a further object of this invention to provide an improved luminaire employing a combination of simple, curved main reflector sections and flat secondary reflector sections, arranged around a source of light, to produce uniform square or rectangular light patterns.

In accordance with a preferred embodiment of this invention, a luminaire has a plurality of curved main reflector sections concentrically located about a bulb mounting location. Additional flat secondary reflector sections are attached to the main reflector sections, and overlie the main reflector sections in locations selected to build up the diagonal distribution of light from the luminaire directed to the corners of square or rectangular areas to be illuminated.

BRIEF DESCRIPTION OF THE DRAWINGS

FIG. 1 is a bottom perspective view of the main reflector section of a preferred embodiment of the invention;

FIG. 1A is a diagrammatic representation of a corner of a square area of the type illuminated by the preferred embodiment of the invention;

FIG. 2 is a detailed bottom view of a preferred embodiment of the invention;

FIG. 3 is a partial cross-sectional view of the preferred embodiment of the invention;

FIG. 4 is an enlargement of the section 4 circled in FIG. 3;

FIG. 5 is an enlargement of the portion 5 circled in FIG. 2 to show greater detail; and FIG. 6 is a perspective view of a secondary reflector section used in the preferred embodiment of the invention.

DETAILED DESCRIPTION

Reference now should be made to the drawings in which the same or similar components have the same reference numbers throughout the different figures.

FIG. 1 is a bottom perspective view of a portion of the construction of a luminaire in accordance with the invention. As illustrated, a housing, such as a rectangular housing 10, shown in dotted lines in FIG. 1, is used to house the reflector sections and other components of the luminaire. The luminaire itself consists of eight simple curved main reflector sections 12, 14, 16, 18, 20, 22, 24, and 26, arranged in a regular octagonal pattern concentrically around an opening 29 in a top or cover plate 28 to which all of the sections are attached. Since the reflector sections are simple curved sections cross sections through each of these sections in planes parallel to the open side of the luminaire, as shown in FIG. 1, all are straight lines. Consequently, the cross sections in planes parallel to the open side of the housing 10 through all of the reflector sections are uniform octagons, which decrease in size as the plane of the cross section moves away from the open side of the luminaire toward the top plate 28. This is illustrated most clearly in FIG. 2, where the maximum octagon is represented by the outer edge of each of the reflector sections, 12, 14, 16, 18, 20, 22, 24 and 26; and the inside octagon, which is apparent in FIG. 2, is where each of the reflector sections is attached to the plate 28. Because these various main reflector sections are simple curves, their manufacture is easily accomplished by bending flat plates of material over suitable forms.

As illustrated most clearly in FIGS. 2, 4 and 5, the lower, or outer edges, of each of the main reflector sections bend outwardly to form integral flanges, 13, 15, 17, 19, 21, 23, 25 and 27, for each of the corresponding reflector sections, 12, 14, 16, 18, 20, 22, 24 and 26. A similar outer flange also is provided at the top, or inner edges, of the reflectors; and only one of these flanges, 43, for the reflector section 12, is illustrated in FIG. 4. It should be understood, however, that each of the other reflector sections have a similar flange to the flange 43, which is shown in detail in FIG. 4. The flange 43 and the corresponding flanges on the other reflector sections are used to attach each of the reflector sections to the top plate 28 of the luminaire by means of suitable rivets 44, or other fasteners.

The lower flanges, such as the flanges 15 and 17 shown in enlarged detail in FIG. 5, are used to attach the reflector sections to a corresponding opening provided in the bottom of the housing 10, as illustrated most clearly in FIG. 3. This attachment may be accomplished in any conventional manner. Once the reflector sections are attached in place in the bottom of the housing 10, a suitable drop cover glass, such as the cover glass 34, shown in FIG. 3, may be added, if desired. Obviously, it is not necessary to use a cover glass, and for some applications, it may be eliminated.

FIG. 1A illustrates the orientation of the main reflector sections 12 through 26 in the housing 10, with respect to one of the corners of a rectangular area to be illuminated The various arrows, which are directed outwardly from the housing 10 shown in FIG. 1A, illustrate beams of light which emanate from such a reflector as shown in FIG. 1. It is apparent that the diagonal beam of light directed to the lower left-hand corner of the area 11 to be illuminated, is longer than those which are directed perpendicular to the sides of the area to be illuminated.

Without additional reflector sections, or modification of some type, the luminaire of FIG. 1 is not capable of providing the same intensity of light in the corners of the area 11 to be illuminated as along the edges. In fact it is readily apparent that the luminaire of FIG. 1 produces a generally circular (octagonal) pattern of light around the luminaire; so that it is not particularly well suited for uniform illumination of square or rectangular areas.

To augment, or intensify, the light directed to the corners of the square 11 which is illuminated by the luminaire, four sets of three auxiliary, or secondary, reflector sections 35 are provided. FIG. 6 is an enlarged perspective view of one of these reflector sections 35. The reflector sections 35 are flat and in the shape of an elongated trapezoid. At the lower edge of the reflector sections 35, a flange 36 is provided with two spaced holes 37 in it. The locations of the holes in the flanges 36 are shown most clearly in FIG. 5, and these holes are aligned with corresponding sets of holes in the main reflector sections located in the corners of the luminaire housing 10, as indicated in FIG. 2.

The secondary reflector sections 35 are attached by means of the flanges 36 and rivets, or other suitable fasteners 40, to the corresponding flanges, such as the flange 13 of the main reflector section 12, shown in FIG. 4. It is apparent that the length of the secondary reflector sections 35 is less than the length of the main reflector sections, and this length is chosen to be as small as possible (for production economy) and no more than the angle of cut off from the area to be illuminated by the luminaire located within the housing 10. It also is apparent that the secondary reflector sections 35 tip inwardly from the opening in the luminaire, as shown most clearly in FIG. 4, with their innermost ends resting on, or touching, the inward curve of the corresponding main reflector sections to which they are attached.

As shown in FIGS. 2 and 5, the secondary reflector sections 35 are located in groups of three at each of the four corners of the housing of the luminaire. The center one of these three reflector sections is located at the joint, or seam, where the edges of the corresponding main reflector sections, such as 14 and 16 shown in FIG. 5, abut one another. The section 35 is located in a plane which is perpendicular to a plane passing through the central axis of the lamp located in the opening 29 and which also bisects the seam, or joint, where the edges of the adjacent main reflector sections, such as 14 and 16, meet. On each side of the central one of the three secondary reflector sections 35, and spaced equally from it on each side, are two additional auxiliary reflector sections 35 as shown most clearly in FIGS. 2 and 5.

The result of this orientation is to direct a substantially greater portion of reflected light from a bulb, such as an HID bulb 31, located in a socket 30 in the opening 29, toward the corners of the square area to be illuminated. This is indicated in FIG. 2 by the substantially greater concentration of arrows shown as a result of the light reflected from the auxiliary and secondary reflector sections 35, located at the junction of the main reflector sections 18 and 20, toward the opposite corner of the square area to be illuminated (namely the lower left corner as shown in FIG. 2).

As shown in FIG. 2, for illuminating a square area, four sets of three reflector sections 35 are used in each set to supplement the main reflector sections of the luminaire, and these sets are located in each of the four corners of the luminaire as shown.

It also is to be noted that the main reflector sections of the luminaire are oriented so that alternate angles of the octagon which is formed by these reflector sections, are aligned with the corners of the area to be illuminated. It should be noted that none of the main reflector sections 12, 14, 16, 18, 20, 22, 24 or 26, are aligned parallel with any of the sides of the square or rectangular area to be illuminated. It has been found that the alignment illustrated diagrammatically in FIG. 1A, and in greater detail in FIG. 2 produces significantly more uniform rectangular or square illumination of the surface located beneath the luminaire than if the orientation was rotated in either direction 22.5°.

A typical size of the luminaire, mounted on poles between 30 and 50 feet above the surface to be lighted, utilizes a housing 10 which is square and has a width of 22.5". In a luminaire which actually has been constructed, the size of the opening covered by the drop glass 34 is 18.5"; and the distance from the opening to the mounting plate 27 is 7.4". The standard operating circuits for the lamp 31 which are connected to the socket 30, are not shown, but they are located in the area between the plate 27 and the top of the housing 10. The total height of the housing 10 from the bottom, shown in FIG. 3, to the top, which is located above the socket 30 is 18". The length of the secondary reflector segments 35 for this structure is 4" and the narrowest, or upper edge, is 2" wide, while the lower, or widest, edge to which the flange 36 is attached, is 3" wide. The trapezoidal shape of the segments 35 is a uniform trapezoid, which is simple to manufacture.

The foregoing description of the preferred embodiment of the invention should be considered as illustrative of the invention and not as limiting. Various changes and modifications will occur to those skilled in the art, without departing from the true scope of the invention as defined in the appended claims.

I claim:

1. A luminaire for producing substantially uniform rectangular patterns of light including, in combination:

a housing having an open side for permitting light to pass outwardly therefrom;

a plurality of curved main reflector sections, extending a pre-determined distance into said housing from said open side with adjacent main reflector sections joined together at the edges thereof, and located concentrically about a bulb mounting location opposite the open side of said housing for reflecting light from a bulb at such location through such open side; and a first, flat secondary reflector section having a length less than said pre-determined distance overlying the joined edges of at least two adjacent main reflector sections and mounted in a plane substantially perpendicular to the plane passing through the joined edges of such two adjacent main reflector sections and the center of the bulb mounting location to modify the pattern of light reflected from the open side of said housing.

2. The combination according to claim 1 further including a second flat secondary reflector section identical to said first flat secondary reflector section overlying the joined edges of two main reflector sections diametrically opposite to the location of said first flat secondary reflector section.

3. The combination according to claim 2 further wherein said luminaire is located within said housing to cause said flat secondary reflector sections to be located in alignment with the corners of a rectangular area to be illuminated by said luminaire.

4. The combination according to claim 3 wherein said plurality of curved main reflector sections comprises eight identical main reflector sections.

5. The combination according to claim 4 further including second, third and fourth flat secondary reflector sections each overlying different joined edges of adjacent main reflector sections at 90° spacings about said bulb mounting location.

6. The combination according to claim 5 further including additional flat auxiliary reflector sections located on opposite sides of each of said flat secondary reflector sections further to concentrate the pattern of light reflected from the locations thereof through the open side of said luminaire.

7. The combination according to claim 1 wherein each of said plurality of curved main reflector sections has an outwardly extending lip thereon, located in a plane parallel to the plane of the open side of said housing; and wherein said flat secondary reflector section has an attaching flange thereon, adapted to overlie said lips on said main reflector sections to facilitate attachment of said secondary reflector section to said main reflector sections.

8. The combination according to claim 1 wherein said plurality of curved main reflector sections comprises at least four main reflector sections.

9. The combination according to claim 1 wherein said plurality of curved main reflector sections comprises eight identical main reflector sections.

10. The combination according to claim 9 further including second, third and fourth flat secondary reflector sections each overlying different joined edges of adjacent main reflector sections at 90° spacings about said bulb mounting location.

11. The combination according to claim 10 further including additional flat auxiliary reflector sections located on opposite sides of each of said flat secondary reflector sections further to concentrate the pattern of light reflected from the locations thereof through the open side of said luminaire.

12. The combination according to claim 1 further wherein said luminaire is located within said housing to cause said flat secondary reflector sections to be located in alignment with the corners of a rectangular area to be illuminated by said luminaire.

13. The combination according to claim 1 further including second, third and fourth flat secondary reflector sections each overlying different joined edges of adjacent main reflector sections at 90° spacings about said bulb mounting location.

14. The combination according to claim 13 wherein said plurality of curved main reflector sections comprises at least four main reflector sections.

15. The combination according to claim 14 further including additional flat auxiliary reflector sections located on opposite sides of each of said flat secondary reflector sections further to concentrate the pattern of light reflected from the locations thereof through the open side of said luminaire.

* * * * *